US007050025B1

(12) United States Patent
Yeung et al.

(10) Patent No.: US 7,050,025 B1
(45) Date of Patent: May 23, 2006

(54) EFFICIENT LIQUID CRYSTAL DISPLAY DRIVING SCHEME USING ORTHOGONAL BLOCK-CIRCULANT MATRIX

(75) Inventors: Steve W. L. Yeung, Tortola (VG); Richard C. H. Lee, Tortola (VG)

(73) Assignee: Varintelligent (BVI) Limited, Tortola (VG)

( * ) Notice: Subject to any disclaimer, the term of this patent is extended or adjusted under 35 U.S.C. 154(b) by 421 days.

(21) Appl. No.: 09/678,058

(22) Filed: Oct. 2, 2000

(30) Foreign Application Priority Data

Jan. 10, 1999 (GB) ..... 9923292.8

(51) Int. Cl.
*G09G 3/36* (2006.01)

(52) U.S. Cl. ..... 345/87; 345/690

(58) Field of Classification Search ..... 345/87, 345/98, 99, 100, 204, 690
See application file for complete search history.

(56) References Cited

U.S. PATENT DOCUMENTS

| | | | | |
|---|---|---|---|---|
| 4,993,075 | A * | 2/1991 | Sekihara et al. | 382/131 |
| 5,657,043 | A * | 8/1997 | Fukui et al. | 345/100 |
| 5,734,364 | A * | 3/1998 | Hirai et al. | 345/95 |
| 5,805,130 | A * | 9/1998 | Yamamoto et al. | 345/100 |
| 5,861,869 | A | 1/1999 | Scheffer et al. | |
| 5,929,832 | A * | 7/1999 | Furukawa et al. | 345/98 |
| 6,054,972 | A * | 4/2000 | Otani et al. | 345/89 |

FOREIGN PATENT DOCUMENTS

EP 0621578 A 10/1994

OTHER PUBLICATIONS

2000 SID International Symposium Digest of Technical Papers, May 16-18, 2000, pp. 587-589, "An Efficient Liquit Crystal Display Driving Scheme Using Orthogonal Block Circulant Matrix ", S. Yeung and R. Lee.
Yeung S., et al., "Paraunitary Matrix Driving Scheme for Liquid Crystal Displays", EuroDisplay '99, Sep. 6-9, 1999, pp. 111-115.
Clifton B et al, "Hardware Architectures For Video-rate, Active Addressed STN Displays", Proceedings of the International Display REsearch Conference Japan Display, 1992, pp. 503-506, XP000444543.
Scheffer T.J. et al, "Active Addressing of STN displays for high-performance video applications", Elsevier Science Publishers Bv., Barking, GB, vol. 14, No. 2, 1993, pp. 74-85.
Fukui Y et al: "7.3: A study of the Active Drive Method For STN-LCDS" SID International Symposium Digest of Tech (Continued)

*Primary Examiner*—Jimmy H. Nguyen
(74) *Attorney, Agent, or Firm*—Blakely Sokoloff Taylor & Zafman

(57) ABSTRACT

The invention relates to a protocol for driving a liquid crystal display, in which a row (common) matrix is made up of orthogonal block-circulant matrices which can be generated by nonlinear programming or alternatively by paraunitary matricing.

12 Claims, 1 Drawing Sheet

$$\begin{bmatrix} 1 & 1 & -1 & 1 & 1 & -1 & 1 & 1 \\ 1 & 1 & 1 & -1 & 1 & -1 & -1 & -1 \\ 1 & 1 & 1 & 1 & -1 & 1 & 1 & -1 \\ -1 & -1 & 1 & 1 & 1 & -1 & 1 & -1 \\ 1 & -1 & 1 & 1 & 1 & 1 & -1 & 1 \\ 1 & -1 & -1 & -1 & 1 & 1 & 1 & -1 \\ -1 & 1 & 1 & -1 & 1 & 1 & 1 & 1 \\ 1 & -1 & 1 & -1 & -1 & -1 & 1 & 1 \end{bmatrix}$$

OTHER PUBLICATIONS nical Papers. San Jose, Jun. 14-16, 1994, Santa Ana, vol. 25, Jun. 14, 1994, pp. 69-72.
http://mathworld.wolfram.com/MethodofSteeperstDescent.html, 2 pages.
Yarlagadda, R.K. Rao, et al., "Hadamard Matrix Analysis and Synthesis", Kluwer Academic Publications, p. 3.
P.J. Davis, "Circulant Matrices", John Wiley & sons, pp. 36-39, p. 176.
Mordecai Avriel, "Nonlinear Programming", Prentice-Hall, p. 288.
http://mathworld.wolfram.com/HadamardMatrix.html.

* cited by examiner $$\begin{bmatrix} 1 & 1 & -1 & 1 & 1 & -1 & 1 & 1 \\ 1 & 1 & 1 & -1 & 1 & -1 & -1 & -1 \\ 1 & 1 & 1 & 1 & -1 & 1 & 1 & -1 \\ -1 & -1 & 1 & 1 & 1 & -1 & 1 & -1 \\ 1 & -1 & 1 & 1 & 1 & 1 & -1 & 1 \\ 1 & -1 & -1 & -1 & 1 & 1 & 1 & -1 \\ -1 & 1 & 1 & -1 & 1 & 1 & 1 & 1 \\ 1 & -1 & 1 & -1 & -1 & -1 & 1 & 1 \end{bmatrix}$$

FIGURE 1

EFFICIENT LIQUID CRYSTAL DISPLAY DRIVING SCHEME USING ORTHOGONAL BLOCK-CIRCULANT MATRIX

BACKGROUND

1. Field

The invention relates to a protocol for driving a liquid crystal display, particularly to a driving scheme of liquid crystal display, and more particularly to a special arrangement of the entries of the driving matrix, which results in an efficient implementation of the scheme and a reduction in hardware complexity.

2. Description of Related Art

Passive matrix driving scheme is commonly adopted for driving a liquid crystal display. For those high-mux displays with liquid crystals of fast response, the problem of loss of contrast due to frame response is severe. To cope with this problem, active addressing was proposed in which an orthogonal matrix is used as the common driving signal. However, the method suffers from the problem of high computation and memory burden. Even worse, the difference in sequencies of the rows of matrix results in different row signal frequencies. This may results in severe crosstalk problems. On the other hand, Multi-Line-Addressing (MLA) was proposed, which makes a compromise between frame response, sequency, and computation problems. The block-diagonal driving matrix is made up of lower order orthogonal matrices. To further suppress the frame response, column interchanges of the driving matrix were suggested in such a way the selections are evenly distributed among the frame. The complexity of the scheme is proportional to square of the order of the building matrix. Increase of order of scheme results in complexity increase in both time and spatial domains. The order increase asks for more logic hardware and voltage levels of the column signal.

SUMMARY

According to the invention there is provided a protocol for driving a liquid crystal display, characterized in that a row (common) driving matrix consists of orthogonal block-circulant matrices.

BRIEF DESCRIPTION OF THE DRAWINGS

FIG. 1 illustrates an orthogonal block-circulant matrix generated by the building blocks of a 2×8 matrix.

DETAILED DESCRIPTION

Liquid Crystal Driving Scheme Using Orthogonal Block-Circulant Matrix

The following shows an order-8 Hadamard matrix.

$$\begin{bmatrix} 1 & 1 & -1 & 1 & 1 & -1 & 1 & 1 \\ 1 & 1 & 1 & -1 & 1 & -1 & -1 & -1 \\ 1 & 1 & 1 & 1 & -1 & 1 & 1 & -1 \\ -1 & -1 & 1 & 1 & 1 & -1 & 1 & -1 \\ 1 & -1 & 1 & 1 & 1 & 1 & -1 & 1 \\ 1 & -1 & -1 & -1 & 1 & 1 & 1 & -1 \\ -1 & 1 & 1 & -1 & 1 & 1 & 1 & 1 \\ 1 & -1 & 1 & -1 & -1 & -1 & 1 & 1 \end{bmatrix}.$$

As mentioned in the foregoing, because of the computation burden and sequency problem of using active driving, MLA was proposed. To implement an 8-way drive by using 4-line MLA, two order-4 Hadamard matrices are used as the diagonal building blocks of the 8×8 driving matrix. The resulting common driving matrix is as follows:

$$\begin{bmatrix} 1 & 1 & 1 & 1 & 0 & 0 & 0 & 0 \\ 1 & -1 & 1 & -1 & 0 & 0 & 0 & 0 \\ 1 & 1 & -1 & -1 & 0 & 0 & 0 & 0 \\ 1 & -1 & -1 & 1 & 0 & 0 & 0 & 0 \\ 0 & 0 & 0 & 0 & 1 & 1 & 1 & 1 \\ 0 & 0 & 0 & 0 & 1 & -1 & 1 & -1 \\ 0 & 0 & 0 & 0 & 1 & 1 & -1 & -1 \\ 0 & 0 & 0 & 0 & 1 & -1 & -1 & 1 \end{bmatrix}.$$

To minimize the sequency problem, another 4×4 orthogonal building block has been proposed. The resulting row (common) driving matrix is as follows:

$$\begin{bmatrix} -1 & 1 & 1 & 1 & 0 & 0 & 0 & 0 \\ 1 & 1 & -1 & 1 & 0 & 0 & 0 & 0 \\ 1 & -1 & 1 & 1 & 0 & 0 & 0 & 0 \\ 1 & 1 & 1 & -1 & 0 & 0 & 0 & 0 \\ 0 & 0 & 0 & 0 & -1 & 1 & 1 & 1 \\ 0 & 0 & 0 & 0 & 1 & 1 & -1 & 1 \\ 0 & 0 & 0 & 0 & 1 & -1 & 1 & 1 \\ 0 & 0 & 0 & 0 & 1 & 1 & 1 & -1 \end{bmatrix}.$$

A general m-way display will have an m×m block diagonal orthogonal driving matrix made up of m/4 (assuming that m is an integer multiple of 4) 4×4 building blocks. The actual voltage applied is not necessary ±1 but a constant multiple of the value (i.e., ±k). To further suppress the frame response, it has been proposed that column interchanges of the row (common) driving matrix such that the selections are evenly distributed among the frame. Using the 8-way drive as example, the following row (common) driving matrix is results:

$$\begin{bmatrix} -1 & 0 & 1 & 0 & 1 & 0 & 1 & 0 \\ 1 & 0 & 1 & 0 & -1 & 0 & 1 & 0 \\ 1 & 0 & -1 & 0 & 1 & 0 & 1 & 0 \\ 1 & 0 & 1 & 0 & 1 & 0 & -1 & 0 \\ 0 & -1 & 0 & 1 & 0 & 1 & 0 & 1 \\ 0 & 1 & 0 & 1 & 0 & -1 & 0 & 1 \\ 0 & 1 & 0 & -1 & 0 & 1 & 0 & 1 \end{bmatrix}.$$

In the invention, there is proposed a method of generating orthogonal block-circulant building blocks that result in reduced hardware complexity of the driving circuitry. First of all, an orthogonal block-circulant matrix is defined as follows:

Definition: An NM×NM block-circulant matrix B consisting of N M×M building blocks $A_1, A_2, \ldots, A_N$ is of the form $$B = \begin{bmatrix} A_1 & A_2 & \cdots & A_N \\ A_N & A_1 & \cdots & A_{N-1} \\ \vdots & \ddots & \ddots & \vdots \\ A_2 & \cdots & A_N & A_1 \end{bmatrix}.$$

It is said to be orthogonal block-circulant if $R^TR=RR^T=(NM)I_{NM}$.

For example, the following 4×4 matrix is orthogonal block-circulant $$\begin{bmatrix} -1 & 1 & 1 & 1 \\ 1 & -1 & 1 & 1 \\ 1 & 1 & -1 & 1 \\ 1 & 1 & 1 & -1 \end{bmatrix}.$$

In this case, N can be 2 or 4. If N=2, then each $A_j$ is 2×2 matrix. If N=4, then each $A_j$ is a scalar (1 or −1). The orthogonal block-circulant matrix can be used as the diagonal building block of a row (common) driving matrix. By proper column and row interchanges, the resulting driving matrix has a property that each row is a shifted version of preceding rows and can be implemented by using shift registers. The following shows the resulting 8-way drive using 4×4 orthogonal block-circulant matrix after suitable row and column interchanges.

$$\begin{bmatrix} -1 & 0 & 1 & 0 & 1 & 0 & 1 & 0 \\ 0 & -1 & 0 & 1 & 0 & 1 & 0 & 1 \\ 1 & 0 & -1 & 0 & 1 & 0 & 1 & 0 \\ 0 & 1 & 0 & -1 & 0 & 1 & 0 & 1 \\ 1 & 0 & 1 & 0 & -1 & 0 & 1 & 0 \\ 0 & 1 & 0 & 1 & 0 & -1 & 0 & 1 \\ 1 & 0 & 1 & 0 & 1 & 0 & -1 & 0 \\ 0 & 1 & 0 & 1 & 0 & 1 & 0 & -1 \end{bmatrix}.$$

For higher order B, the choice of the order of sub-block $A_j$ is limited. Some M might result in non-existence of orthogonal block-circulant B. Let MN=6, then M, the order of sub-block, can be 1, 2, or 3. It can be shown that orthogonal block-circulant B can be achieved by M=2, 3, but not M=1. In general, given that MN is even it can be shown that orthogonal block-circulant B always exists provided that M≠1. In the following, two means of generating orthogonal block-circulant matrices are proposed.

The first method is based on theory of paraunitary matrix but it by no means generates all orthogonal block-circulant matrices. The second method is a means to identify orthogonal block-circulant matrices by nonlinear programming. Theoretically, it can be used to generate all orthogonal block-circulant matrices.

Generation of Orthogonal Block-Circulant Matrix Using Paraunitary Matrix

Consider order M×NM sub-matrix of B as follows:

$$E=[A_1\ A_2 \ldots A_N]$$

Define n×n shift matrix $S_{n,m}$ as follows $$S_{n,m} = \begin{bmatrix} 0 & I_{mxm} \\ 0_{(n-m)x(n-m)} & 0 \end{bmatrix}.$$

A paraunitary matrix E of order M×NM satisfies

E is orthogonal. i.e., $$EE^T=I$$

E is orthogonal to its column shift by multiples of M. i.e., $$ES_{NM,iM}E^T=0$$

for i=1,2, . . . , N−1.

In general, paraunitary matrices can be represented in a cascade lattice form with rotational angles as parameters.

The following are two example 2×4 paraunitary matrices.

$$E_1 = \begin{bmatrix} 1 & 1 & -1 & 1 \\ -1 & -1 & -1 & 1 \end{bmatrix}$$

$$E_2 = \begin{bmatrix} -1 & 1 & 1 & 1 \\ 1 & -1 & 1 & 1 \end{bmatrix}$$

We have the following property of paraunitary matrices: Property: B generated by block-circulating paraunitary E is orthogonal. Proof: Define n×n recurrent shift matrix $R_{n,m}$ as follows $$R_{n,m} = \begin{bmatrix} 0 & I_{mxm} \\ I_{(n-m)x(n-m)} & 0 \end{bmatrix}$$

An orthogonal block-circulant matrix B of order NM×NM with M×NM sub-matrix E satisfies (i) E is orthogonal. i.e., $$EE^T=1$$

(ii) E is orthogonal to its recurrent shift by multiples of M. i.e., $$ER_{NM,iM}E^T=0$$

for i=1, 2, . . . , N−1.

Provided that E is paraunitary, as $$R_{n,m} = S_{n,m} + S^T_{n-m,n-m}$$

we have $$\begin{aligned} ER_{NM,iM}E^T &= E(S_{NM,iM} + S^T_{(N-i)M,(N-i)M})E^T \\ &= ES_{NM,iM}E^T + ES^T_{(N-i)M,(N-i)M}E^T = 0 \end{aligned}$$

and that completes the proof. Notice that E is paraunitary is a sufficient but not necessary condition for B to be orthogonal block-circulant. Using $E_1$ and $E_2$ as building blocks, we obtain the following orthogonal block-circulant matrices.

$$B_1 = \begin{bmatrix} 1 & 1 & -1 & 1 \\ -1 & -1 & -1 & 1 \\ -1 & 1 & 1 & 1 \\ -1 & 1 & -1 & -1 \end{bmatrix}$$

$$B_2 = \begin{bmatrix} -1 & 1 & 1 & 1 \\ 1 & -1 & 1 & 1 \\ 1 & 1 & -1 & 1 \\ 1 & 1 & 1 & -1 \end{bmatrix}$$

Notice that $B_2$ is orthogonal circulant as well as orthogonal block-circulant. As illustrated before, by using it as the building block of row (common) driving matrix with suitable row and column interchanges, each row is a delay-1 shifted version of preceding row. However, $B_1$ is orthogonal block-circulant but it is not circulant. By suitable row and column interchanges of the resulting driving matrix, two sets of row (common) driving waveforms are obtained. Within a set, each row is a shifted version of the others. The complexity of implementation is proportional to the order of the sub-blocks $A_j$ (i.e., M). For NM=4, we observe that M can be 1 or 2. For higher order, M=1 does not result in any circulant B always exists and can be generated by 2×2N paraunitary matrices. The driving matrix resulted from $B_2$ with suitable column interchanges is shown below:

$$\begin{bmatrix} 1 & 0 & 1 & 0 & -1 & 0 & 1 & 0 \\ -1 & 0 & -1 & 0 & -1 & 0 & 1 & 0 \\ -1 & 0 & 1 & 0 & 1 & 0 & 1 & 0 \\ -1 & 0 & 1 & 0 & -1 & 0 & -1 & 0 \\ 0 & 1 & 0 & 1 & 0 & -1 & 0 & 1 \\ 0 & -1 & 0 & -1 & 0 & -1 & 0 & 1 \\ 0 & -1 & 0 & 1 & 0 & 1 & 0 & 1 \\ 0 & -1 & 0 & 1 & 0 & -1 & 0 & -1 \end{bmatrix}$$

Rows 1, 3, 5, 7 and 2, 4, 6, 8 form the two sets within which each row is a shifted version of the others.

Generation of Orthogonal Block-Circulant Matrix by Nonlinear Programming

We might also generate orthogonal block-circulant matrix by nonlinear programming. We use the method of steepest descent to illustrate the idea. The method of steepest descent is widely used in the identification of complex and nonlinear systems. The update law in identifying sub-matrix E can be stated as follows:

$$E_{n+1} = E_n + \delta \frac{\partial P}{\partial E}$$

where_is the step size. P is the cost or penalty function. We set P as follows:

$$P(E) = \sum_{i,j} (e_{ij}^2 - 1)^2 + \|EE^T - I\|_F^2 + \sum_i \|ER_{NM,iM} E^T\|_F^2$$

$e_{ij}$ are the entries of E. $\| \|_F$ is the Frobenius norm of a matrix. The first summation in the function forces all the entries of E to be ±1. The second one forces E to be orthogonal, while the third summation ensures orthogonal block-circulant property of the resulting B.

List of Order-4 and Order-8 Orthogonal Block-Circulant Matrices

The following is an exhaustion of all 2×4 and 2×8 sub-matrices E with entries ±1 that result in orthogonal block-circulant building block.

Order-4

$$\begin{bmatrix} 1 & 1 & -1 & 1 \\ 1 & 1 & 1 & -1 \end{bmatrix}; \quad (1)$$

$$\begin{bmatrix} -1 & 1 & 1 & 1 \\ 1 & 1 & 1 & -1 \end{bmatrix}; \quad (2)$$

$$\begin{bmatrix} -1 & 1 & -1 & -1 \\ 1 & 1 & -1 & 1 \end{bmatrix}; \quad (3)$$

$$\begin{bmatrix} -1 & -1 & -1 & 1 \\ 1 & 1 & -1 & 1 \end{bmatrix}; \quad (4)$$

all alternatives of (1)–(4) generated by sign inversion (i.e., −E);

row interchange, i.e., $$\begin{bmatrix} 0 & 1 \\ 1 & 0 \end{bmatrix} E;$$

circulant shift of E, i.e., $$ER_{4,2};$$

and any combinations of (i)–(iii).

Order-8

$$\begin{bmatrix} 1 & 1 & -1 & 1 & 1 & -1 & 1 & 1 \\ 1 & 1 & 1 & -1 & 1 & -1 & -1 & -1 \end{bmatrix}; \quad (1)$$

$$\begin{bmatrix} 1 & 1 & 1 & -1 & 1 & -1 & -1 & -1 \\ 1 & 1 & 1 & 1 & -1 & 1 & 1 & -1 \end{bmatrix}; \quad (2)$$

$$\begin{bmatrix} 1 & 1 & -1 & -1 & -1 & 1 & -1 & -1 \\ 1 & 1 & 1 & 1 & -1 & 1 & 1 & -1 \end{bmatrix}; \quad (3)$$

$$\begin{bmatrix} 1 & 1 & -1 & 1 & -1 & 1 & -1 & -1 \\ 1 & 1 & 1 & 1 & 1 & -1 & -1 & 1 \end{bmatrix}; \quad (4)$$

$$\begin{bmatrix} -1 & 1 & -1 & 1 & 1 & -1 & -1 & 1 \\ 1 & 1 & 1 & 1 & 1 & 1 & -1 & -1 \end{bmatrix}; \quad (5)$$

-continued $$\begin{bmatrix} -1 & 1 & -1 & 1 & -1 & 1 & 1 & -1 \\ 1 & 1 & 1 & 1 & 1 & 1 & -1 & -1 \end{bmatrix}; \quad (6)$$

$$\begin{bmatrix} -1 & 1 & -1 & 1 & 1 & 1 & -1 & -1 \\ 1 & 1 & 1 & 1 & -1 & 1 & 1 & -1 \end{bmatrix}; \quad (7)$$

$$\begin{bmatrix} -1 & 1 & 1 & -1 & 1 & -1 & 1 & -1 \\ 1 & 1 & 1 & 1 & 1 & 1 & -1 & -1 \end{bmatrix}; \quad (8)$$

$$\begin{bmatrix} -1 & 1 & 1 & 1 & 1 & 1 & 1 & -1 \\ 1 & 1 & -1 & 1 & -1 & 1 & -1 & -1 \end{bmatrix}; \quad (9)$$

$$\begin{bmatrix} -1 & 1 & -1 & 1 & -1 & 1 & 1 & -1 \\ 1 & 1 & -1 & -1 & -1 & -1 & -1 & -1 \end{bmatrix}; \quad (10)$$

$$\begin{bmatrix} -1 & 1 & 1 & -1 & -1 & -1 & -1 & -1 \\ 1 & 1 & -1 & 1 & -1 & 1 & -1 & -1 \end{bmatrix}; \quad (11)$$

$$\begin{bmatrix} 1 & -1 & -1 & 1 & -1 & 1 & -1 & 1 \\ 1 & 1 & 1 & 1 & 1 & 1 & -1 & -1 \end{bmatrix}; \quad (12)$$

$$\begin{bmatrix} 1 & -1 & -1 & 1 & 1 & -1 & 1 & -1 \\ 1 & 1 & 1 & 1 & 1 & 1 & -1 & -1 \end{bmatrix}; \quad (13)$$

$$\begin{bmatrix} 1 & -1 & 1 & -1 & 1 & -1 & -1 & 1 \\ 1 & 1 & 1 & 1 & 1 & 1 & -1 & -1 \end{bmatrix}; \quad (14)$$

$$\begin{bmatrix} 1 & -1 & -1 & 1 & -1 & -1 & -1 & -1 \\ 1 & 1 & 1 & -1 & 1 & -1 & -1 & -1 \end{bmatrix}; \quad (15)$$

$$\begin{bmatrix} 1 & -1 & 1 & -1 & 1 & 1 & -1 & -1 \\ 1 & 1 & 1 & 1 & 1 & -1 & -1 & 1 \end{bmatrix}; \quad (16)$$

$$\begin{bmatrix} 1 & -1 & 1 & 1 & 1 & 1 & -1 & 1 \\ 1 & 1 & 1 & -1 & 1 & -1 & -1 & -1 \end{bmatrix}; \quad (17)$$

$$\begin{bmatrix} 1 & 1 & -1 & 1 & 1 & 1 & 1 & -1 \\ -1 & 1 & 1 & 1 & -1 & 1 & -1 & -1 \end{bmatrix}; \quad (18)$$

$$\begin{bmatrix} 1 & 1 & 1 & -1 & 1 & 1 & -1 & 1 \\ -1 & 1 & 1 & 1 & -1 & 1 & -1 & -1 \end{bmatrix}; \quad (19)$$

$$\begin{bmatrix} 1 & 1 & -1 & 1 & 1 & 1 & 1 & -1 \\ 1 & -1 & 1 & 1 & 1 & -1 & -1 & -1 \end{bmatrix}; \quad (20)$$

$$\begin{bmatrix} 1 & 1 & 1 & -1 & 1 & 1 & -1 & 1 \\ 1 & -1 & 1 & 1 & 1 & -1 & -1 & -1 \end{bmatrix}; \quad (21)$$

$$\begin{bmatrix} -1 & 1 & 1 & 1 & 1 & -1 & 1 & 1 \\ -1 & 1 & 1 & 1 & -1 & 1 & -1 & -1 \end{bmatrix}; \quad (22)$$

$$\begin{bmatrix} -1 & -1 & -1 & 1 & 1 & -1 & -1 & -1 \\ 1 & 1 & -1 & 1 & -1 & 1 & -1 & -1 \end{bmatrix}; \quad (23)$$

$$\begin{bmatrix} -1 & 1 & -1 & -1 & 1 & -1 & -1 & -1 \\ -1 & 1 & 1 & 1 & -1 & 1 & -1 & -1 \end{bmatrix}; \quad (24)$$

$$\begin{bmatrix} 1 & -1 & 1 & 1 & -1 & 1 & 1 & 1 \\ -1 & 1 & 1 & 1 & -1 & 1 & -1 & -1 \end{bmatrix}; \quad (25)$$

$$\begin{bmatrix} 1 & -1 & -1 & -1 & -1 & 1 & -1 & -1 \\ -1 & 1 & 1 & 1 & -1 & 1 & -1 & -1 \end{bmatrix}; \quad (26)$$

$$\begin{bmatrix} 1 & -1 & 1 & -1 & 1 & 1 & -1 & -1 \\ -1 & 1 & 1 & -1 & -1 & -1 & -1 & -1 \end{bmatrix}; \quad (27)$$

all alternatives of (1)–(27) generated by sign inversion (i.e., −E);

row interchange, i.e., $$\begin{bmatrix} 0 & 1 \\ 1 & 0 \end{bmatrix} E;$$

circulant shift of E, i.e., $$ER_{8,2i};$$

i=1, 2, or 3, and any combinations of (i)–(iii).

Thus using the invention a special arrangement of the entries of driving matrix is proposed. By imposing orthogonal block-circulant property to the building blocks of the row (common) driving waveform, the row signals can be made to differ by time shifts only. Each row can now be implemented as a shifted version of preceding rows by using shift registers. The complexity of the matrix driving scheme is greatly reduced and is linearly proportional to the order of the orthogonal block-circulant building block.

We claim:

1. A driving scheme for operation of a liquid crystal display comprising:

(i) a plurality of orthogonal addressing functions;

(ii) said plurality of orthogonal addressing functions comprising a row (common) driving matrix;

(iii) wherein said plurality of addressing functions are applied to a plurality of rows of a display matrix; and (iv) said plurality of orthogonal addressing functions is represented by an orthogonal block-circulant matrix, the orthogonal block-circulant matrix comprising at least one sub-matrix;

(v) wherein at least one of said at least one sub-matrix is non-zero and non-orthogonal.

2. A method as defined in claim 1, wherein there are row and column interchanges of said addressing functions.

3. A method as defined in claim 1, wherein said row (common) driving matrix is a block diagonal matrix, said block diagonal matrix comprising building blocks, and wherein all the building blocks are orthogonal block-circulant.

4. A method as defined in claim 3, wherein said row (common) driving matrix is a row and column interchanged version of the row (common) driving matrix.

5. A method as defined in claim 1, wherein said row (common) driving matrix comprises orthogonal block-circulant building blocks generated by using a paraunitary matrix.

6. A method as defined in claim 5, wherein said driving matrix is $$\begin{bmatrix} 1 & 0 & 1 & 0 & -1 & 0 & 1 & 0 \\ -1 & 0 & -1 & 0 & -1 & 0 & 1 & 0 \\ -1 & 0 & 1 & 0 & 1 & 0 & 1 & 0 \\ -1 & 0 & 1 & 0 & -1 & 0 & -1 & 0 \\ 0 & 1 & 0 & 1 & 0 & -1 & 0 & 1 \\ 0 & -1 & 0 & -1 & 0 & -1 & 0 & 1 \\ 0 & -1 & 0 & 1 & 0 & 1 & 0 & 1 \\ 0 & -1 & 0 & 1 & 0 & -1 & 0 & -1 \end{bmatrix}.$$

7. A method as defined in claim 1, wherein said row (common) driving matrix is based on orthogonal block-circulant building blocks generated by nonlinear programming.

8. A method as defined in claim 7, wherein said row (common) driving matrix is based on order-4 orthogonal block-circulant building blocks.

9. A method as defined in claim 8, wherein said building blocks comprise:

$$\begin{bmatrix} 1 & 1 & -1 & 1 \\ 1 & 1 & 1 & -1 \end{bmatrix}; \quad (1)$$

$$\begin{bmatrix} -1 & 1 & 1 & 1 \\ 1 & 1 & 1 & -1 \end{bmatrix}; \quad (2)$$

$$\begin{bmatrix} -1 & 1 & -1 & -1 \\ 1 & 1 & -1 & 1 \end{bmatrix}; \quad (3)$$

$$\begin{bmatrix} -1 & -1 & -1 & 1 \\ 1 & 1 & -1 & 1 \end{bmatrix};$$

(5) all alternatives of (1)–(4) generated by (i) sign inversion (i.e., –E);

(ii) row interchange, i.e., $$\begin{bmatrix} 0 & 1 \\ 1 & 0 \end{bmatrix} E;$$

(iii) circulant shift of E, i.e., $$ER_{4,2};$$

and any combinations of (i)–(iii).

10. A method as defined in claim 7, wherein said row (common) driving matrix is based on order-8 orthogonal block-circulant building blocks.

11. A method as defined in claim 10, wherein said building blocks comprise $$\begin{bmatrix} 1 & 1 & -1 & 1 & 1 & -1 & 1 & 1 \\ 1 & 1 & 1 & -1 & 1 & -1 & -1 & -1 \end{bmatrix}; \quad (1)$$

$$\begin{bmatrix} 1 & 1 & 1 & -1 & 1 & -1 & -1 & -1 \\ 1 & 1 & 1 & 1 & -1 & 1 & 1 & -1 \end{bmatrix}; \quad (2)$$

$$\begin{bmatrix} 1 & 1 & -1 & -1 & -1 & 1 & -1 & -1 \\ 1 & 1 & 1 & 1 & -1 & 1 & 1 & -1 \end{bmatrix}; \quad (3)$$

$$\begin{bmatrix} 1 & 1 & -1 & 1 & -1 & 1 & -1 & -1 \\ 1 & 1 & 1 & 1 & 1 & -1 & -1 & 1 \end{bmatrix}; \quad (4)$$

$$\begin{bmatrix} -1 & 1 & -1 & 1 & 1 & -1 & -1 & 1 \\ 1 & 1 & 1 & 1 & 1 & 1 & -1 & -1 \end{bmatrix}; \quad (5)$$

$$\begin{bmatrix} -1 & 1 & -1 & 1 & -1 & 1 & 1 & -1 \\ 1 & 1 & 1 & 1 & 1 & 1 & -1 & -1 \end{bmatrix}; \quad (6)$$

$$\begin{bmatrix} -1 & 1 & -1 & 1 & 1 & 1 & -1 & -1 \\ 1 & 1 & 1 & 1 & -1 & 1 & 1 & -1 \end{bmatrix}; \quad (7)$$

$$\begin{bmatrix} -1 & 1 & 1 & -1 & 1 & -1 & 1 & -1 \\ 1 & 1 & 1 & 1 & 1 & 1 & -1 & -1 \end{bmatrix}; \quad (8)$$

$$\begin{bmatrix} -1 & 1 & 1 & 1 & 1 & 1 & 1 & -1 \\ 1 & 1 & -1 & 1 & -1 & 1 & -1 & -1 \end{bmatrix}; \quad (9)$$

$$\begin{bmatrix} -1 & 1 & -1 & 1 & -1 & 1 & 1 & -1 \\ 1 & 1 & -1 & -1 & -1 & -1 & -1 & -1 \end{bmatrix}; \quad (10)$$

$$\begin{bmatrix} -1 & 1 & 1 & -1 & -1 & -1 & -1 & -1 \\ 1 & 1 & -1 & 1 & -1 & 1 & -1 & -1 \end{bmatrix}; \quad (11)$$

$$\begin{bmatrix} 1 & -1 & -1 & 1 & -1 & 1 & -1 & 1 \\ 1 & 1 & 1 & 1 & 1 & 1 & -1 & -1 \end{bmatrix}; \quad (12)$$

$$\begin{bmatrix} 1 & -1 & -1 & 1 & 1 & -1 & 1 & -1 \\ 1 & 1 & 1 & 1 & 1 & 1 & -1 & -1 \end{bmatrix}; \quad (13)$$

$$\begin{bmatrix} 1 & -1 & 1 & -1 & 1 & -1 & -1 & 1 \\ 1 & 1 & 1 & 1 & 1 & 1 & -1 & -1 \end{bmatrix}; \quad (14)$$

$$\begin{bmatrix} 1 & -1 & -1 & 1 & -1 & -1 & -1 & -1 \\ 1 & 1 & 1 & -1 & 1 & -1 & -1 & -1 \end{bmatrix}; \quad (15)$$

$$\begin{bmatrix} 1 & -1 & 1 & -1 & 1 & 1 & -1 & -1 \\ 1 & 1 & 1 & 1 & 1 & -1 & -1 & 1 \end{bmatrix}; \quad (16)$$

$$\begin{bmatrix} 1 & -1 & 1 & 1 & 1 & 1 & -1 & 1 \\ 1 & 1 & 1 & -1 & 1 & -1 & -1 & -1 \end{bmatrix}; \quad (17)$$

$$\begin{bmatrix} 1 & 1 & -1 & 1 & 1 & 1 & 1 & -1 \\ -1 & 1 & 1 & 1 & -1 & 1 & -1 & -1 \end{bmatrix}; \quad (18)$$

$$\begin{bmatrix} 1 & 1 & 1 & -1 & 1 & 1 & -1 & 1 \\ -1 & 1 & 1 & 1 & -1 & 1 & -1 & -1 \end{bmatrix}; \quad (19)$$

$$\begin{bmatrix} 1 & 1 & -1 & 1 & 1 & 1 & 1 & -1 \\ 1 & -1 & 1 & 1 & 1 & -1 & -1 & -1 \end{bmatrix}; \quad (20)$$

$$\begin{bmatrix} 1 & 1 & 1 & -1 & 1 & 1 & -1 & 1 \\ 1 & -1 & 1 & 1 & 1 & -1 & -1 & -1 \end{bmatrix}; \quad (21)$$

$$\begin{bmatrix} -1 & 1 & 1 & 1 & 1 & -1 & 1 & 1 \\ -1 & 1 & 1 & 1 & -1 & 1 & -1 & -1 \end{bmatrix}; \quad (22)$$

$$\begin{bmatrix} -1 & -1 & -1 & 1 & 1 & -1 & -1 & -1 \\ 1 & 1 & -1 & 1 & -1 & 1 & -1 & -1 \end{bmatrix}; \quad (23)$$

$$\begin{bmatrix} -1 & 1 & -1 & -1 & 1 & -1 & -1 & -1 \\ -1 & 1 & 1 & 1 & -1 & 1 & -1 & -1 \end{bmatrix}; \quad (24)$$

$$\begin{bmatrix} 1 & -1 & 1 & 1 & -1 & 1 & 1 & 1 \\ -1 & 1 & 1 & 1 & -1 & 1 & -1 & -1 \end{bmatrix}; \quad (25)$$

$$\begin{bmatrix} 1 & -1 & -1 & -1 & -1 & 1 & -1 & -1 \\ -1 & 1 & 1 & 1 & -1 & 1 & -1 & -1 \end{bmatrix}; \quad (26)$$

$$\begin{bmatrix} 1 & -1 & 1 & -1 & 1 & 1 & -1 & -1 \\ -1 & 1 & 1 & -1 & -1 & -1 & -1 & -1 \end{bmatrix}; \quad (27)$$

(28) all alternatives of (1)–(27) generated by (i) sign inversion (i.e., −E);

(ii) row interchange, i.e., $$\begin{bmatrix} 0 & 1 \\ 1 & 0 \end{bmatrix} E;$$

(iii) circulant shift of E, i.e., $$ER_{8,2i};$$

for i=1, 2, or 3, and any combinations of (i)–(iii).

12. A liquid crystal display, wherein there is a driving scheme as defined in claim 1.

* * * * *

UNITED STATES PATENT AND TRADEMARK OFFICE

CERTIFICATE OF CORRECTION

PATENT NO. : 7,050,025 B1
APPLICATION NO. : 09/678058
DATED : May 23, 2006
INVENTOR(S) : Yeung et al.

It is certified that error appears in the above-identified patent and that said Letters Patent is hereby corrected as shown below:

In Col. 8 line 39 Claim #2, please delete “A method” and insert -- The driving scheme --.

In Col. 8 line 41 Claim #3, please delete “A method” and insert -- The driving scheme --.

In Col. 8 line 46 Claim #4, please delete “A method” and insert -- The driving scheme --.

In Col. 8 line 49 Claim #5, please delete “A method” and insert -- The driving scheme --.

In Col. 8 line 53 Claim #6, please delete “A method” and insert -- The driving scheme --.

In Col. 9, line 1 Claim #7, please delete “A method” and insert -- The driving scheme --.

In Col. 9, line 5 Claim #8, please delete “A method” and insert -- The driving scheme --.

In Col. 9, line 8 Claim #9, please delete “A method” and insert -- The driving scheme --.

In Col. 9, line 45 Claim #10, please delete “A method” and insert -- The driving scheme --.

In Col. 9, line 48 Claim #11, please delete “A method” and insert -- The driving scheme --.

Signed and Sealed this

Thirteenth Day of November, 2007

JON W. DUDAS
*Director of the United States Patent and Trademark Office*